United States Patent [19]

Hipp

[11] 4,258,800

[45] Mar. 31, 1981

[54] HINGED CONDUCTOR CASING FOR DEVIATED DRIVING AND METHOD THEREFOR

[75] Inventor: James Hipp, New Iberia, La.

[73] Assignee: Petro-Drive, Inc., Lafayette, La.

[21] Appl. No.: 35,635

[22] Filed: May 3, 1979

[51] Int. Cl.[3] ..... E21B 7/08

[52] U.S. Cl. ..... 175/61; 175/74; 175/75; 175/79

[58] Field of Search ..... 175/61, 73–75, 175/256, 79; 405/184, 251

[56] References Cited

U.S. PATENT DOCUMENTS

| | | | |
|---|---|---|---|
| 3,610,346 | 10/1971 | Ziober | 175/61 X |
| 4,007,797 | 2/1977 | Jeter | 175/61 |
| 4,027,734 | 6/1977 | Horvath | 175/73 X |
| 4,042,046 | 8/1977 | Capoccia | 175/61 X |

*Primary Examiner*—William F. Pate, III
*Attorney, Agent, or Firm*—Bernard A. Reiter

[57] ABSTRACT

A method and apparatus for deviating a conductor casing, or the like, after it has been driven into a substratum, generally beneath the floor of a body of water. The conductor casing is characterized by a drive shoe assembly on the end thereof having a bevel cut extending therethrough for up to 180 degrees of the circumference thereof, or more, and thereby providing a residual connection characterized as a hinge means. The conductor casing and drive shoe is characterized in operation by an entire linear configuration until they are driven beneath the floor into the substratum, at which time the hinge means allows closure of the distal end through the arc of the bevel cut thereby providing a deviated section which produces directional implacement of the conductor casing.

11 Claims, 10 Drawing Figures

HINGED CONDUCTOR CASING FOR DEVIATED DRIVING AND METHOD THEREFOR

BACKGROUND OF THE INVENTION

1. Field of the Invention

This invention relates to conductor casings for oil and gas wells. More specifically, the invention is directed to a new and improved method and apparatus for deviating the conductor casing of the well as it is being driven into the substratum.

2. Description of the Prior Art

It is commonly known that oil and gas wells are commonly driven at varying slanted angles for a variety of reasons. For example, in order to increase the lateral reach of the well, or in order to tap a deposit in a number of locations, the conductors have been driven at a slant, with respect to vertical. In this procedure, the conductor casing itself generally remains uncurved, although the conductors have been pre-curved prior to their being driven into the substratum. One known method describes conductor driving by forcing them through an arcuately positioned set of guide members affixed to the superstructure of the platform. An example of a straight conductor driven at a slanted angle is shown in the U.S. Pat. No. 3,451,493. In offshore wells, the conductors are usually extended laterally beyond the perimeter of a platform at a substantial distance above the mud line thus producing an undesirable condition since it results in long spans of conductors which are unsupported or which require fabrication of conductor guides exteriorly of the main framework of the platform. This results in increased costs, time and unnecessary complications. An example of conductors which are slanted or curved during driving by forcing the conductors through a plurality of offset guide members is shown in U.S. Pat. No. 3,670,507. This type of apparatus and method is generally deficient because it precludes versatility in drilling due to the fixed construction of the guide means on the platform, and in any event the amount of curvature that can be obtained in the casing is predetermined by the preset guide means and may not be changed.

It thus becomes desirable to provide for a deviated conductor casing which is neither driven at an original slant or precurved through a series of arcuate guide members. In other words, it becomes desirable to drive the conductor pipe substantially vertically into the substratum and cause it to be deviated thereafter. In this regard, attention may be directed to U.S. Pat. No. 4,027,734 wherein there is shown a method for a deviated implacement of a conductor casing at a desired orientation in order to facilitate directional drilling of a well in the substratum at an offshore site. Here, there is suggested the method of diverting a conductor by means of welding a short section of pipe on the bottom of the conductor at a slight angle to the axis of the conductor. Before the straight conductor pipe is inserted in the vertically aligned guides, the short section is cut off and re-welded at a slight angle to the axis, thus creating a "dog-leg" for diverting the conductor in a predetermined direction as it is forced through the substratum soils. A problem, and limiting factor, arising with use of such a "dog-leg" deviated conductor is that the dog-leg itself can be deviated only a very minor distance off of the center line of the pipe due to the diameter of the preset guides. This offset distance may vary from ½ inch to the clearance allowed by the guide through which the offset section must pass. Such pre-set dog-leg section, commonly affixed such as by welding, is not only restricted as to the magnitude of the dog-leg to its inability to pass through a series of guide means, but also is substantially obstructed from utilization on a pre-curved conductor for the same reason.

SUMMARY OF THE INVENTION

The present invention is utilized for the placement of deviated conductors from an offshore platform, generally where there is a plurality of conductor pipes to be driven from the platform in a number of different directions so that the lateral reach for hydrocarbon product can be substantially extended by deviating each conductor pipe in its predetermined direction. The invention is applicable to the placement of conductor pipe in a variety of circumstances, such as for example: (1) where there is included on the platform a series of standard conductor guides which are vertically aligned, that is, where their openings define a straight line in at least a generally vertical direction; or (2) where the conductor guides define an arcuate path through the platform above and/or below the surface and down to the mud line; or (3) where the conductor pipe is oriented in linear fashion from the platform to the mud line but slanted at an angle with respect to the vertical.

The present invention comprises the apparatus and method of diverting a conductor pipe by means of a directional shoe affixed, such as by welding, to the end of the conductor pipe. The directional shoe is characterized by a bevel shaped cut out portion through the circumference of the conductor shoe. The bevel or pie-shaped cut extends through only a portion of the circumference of the shoe to circumferentially opposed points at which there is provided a hinge means which, upon the application of pile driving force to the conductor pipe causes the shoe to close the bevel cut by movement of the lower portion of the shoe about its hinge means. There thus results an angulated lower portion of the shoe compressed firmly against the upper portion of the shoe so as to produce an offset section causing deviated movement of the conductor pipe in the general direction of the axis of the deviated section of pipe. It is known that this deviated section of the pipe causes the conductor to divert in a predetermined direction as the pile driving hammer forces the conductor through the substratum soils.

It has been found that the deviated section will cause the conductor pipe to not only be diverted in the direction generally of the section axis, but also that the maximum heights of the bevel cut and the depth of the bevel cut affect the angle of deviation of the pipe. Thus, by utilizing varying angles in the cut out portion in the directional shoe the conductor pipe can be constructed to move in a predetermined path. Due to the fact that the directional shoe does not deviate until after it is driven beneath the soil, it can be readily disposed through platform guide means with ease. Theseand numerous other features will become apparent upon a careful reading of the following detailed description, claims and drawings, wherein like numerals denote like parts in the several views and wherein:

DETAILED DESCRIPTION

Figure 1:
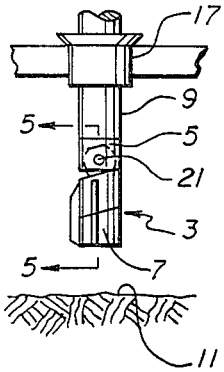
FIG. 1 is a frontal elevation showing the position of a collapsible drive shoe in accordance with the invention after having penetrated the floor of a body of water.
Figure 5:
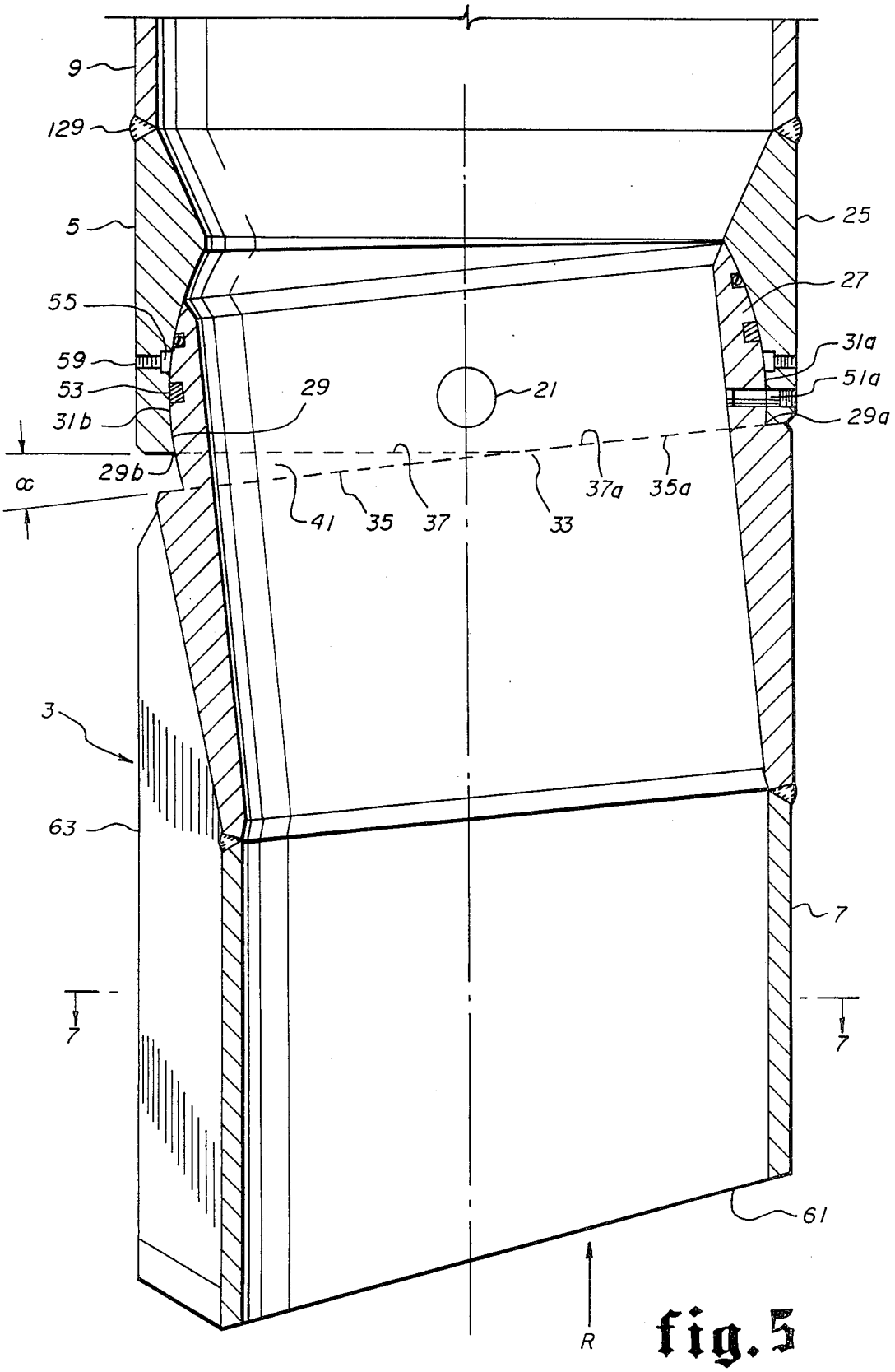
FIG. 5 is a vertical section view through the collapsible drive shoe of FIG. 1 along the plane 5—5 thereof.

With reference now to FIGS. 1 and 5, there is shown a collapsible drive shoe means 3 embodying the concept of the invention herein and which comprises an upper support means 5 and a lower movable shoe means 7 adapted to pivot with respect to the upper support means 5 after the conductor 9 to which the shoe means 3 is affixed has been driven beneath the floor 11 of a body of water. The floor 11, commonly referred to as the "mud line", does not present significant resistance to the movable shoe means 7 and as a result the lower shoe and the upper support means 5 remain in linear alignment with one another, such that the central axis of upper support means 5 and the central axis of lower movable shoe means 7 remain in alignment with one another after the shoe 3 has penetrated and been driven beneath the floor 11 of the body of water. Typically, the resistance point at which the movable shoe means 7 initiates pivotal movement occurs at between 10 to 150 feet beneath the floor 11.

Figure 2:
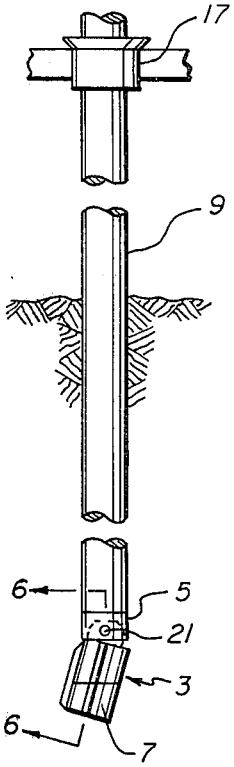
FIG. 2 is a frontal elevation of the collapsible drive shoe of FIG. 1 after it has been driven to the point of resistance beneath the surface of the floor of a body of water.
Figure 3:
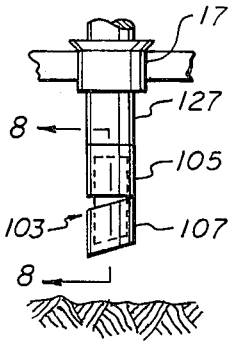
FIG. 3 is a frontal elevation of an alternative form of a collapsible drive shoe in accordance with the invention, after having penetrated the floor of a body of water.
Figure 4:
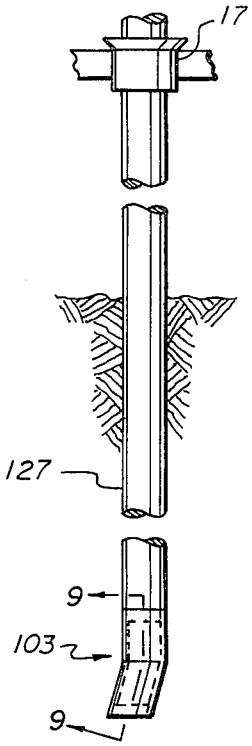
FIG. 4 is a frontal elevation of the collapsible drive shoe of FIG. 3 after it has been driven to the point of resistance beneath the surface of the floor of a body of water.

In FIG. 2, there is shown an illustration of the collapsible drive shoe of FIG. 1 showing the approximate depth level 13 at which movable shoe means 7 begins its pivotal turn thereby initiating directional travel of the conductor 9. The depth at which shoe means 7 initiates pivotal movement may, however, be predetermined by knowledge and analysis of the sub-surface of floor 11 and by subsequently designing the connection means between upper support means 5 and lower movable shoe means 7 in accordance with the principals discussed hereinafter.

Figure 6:
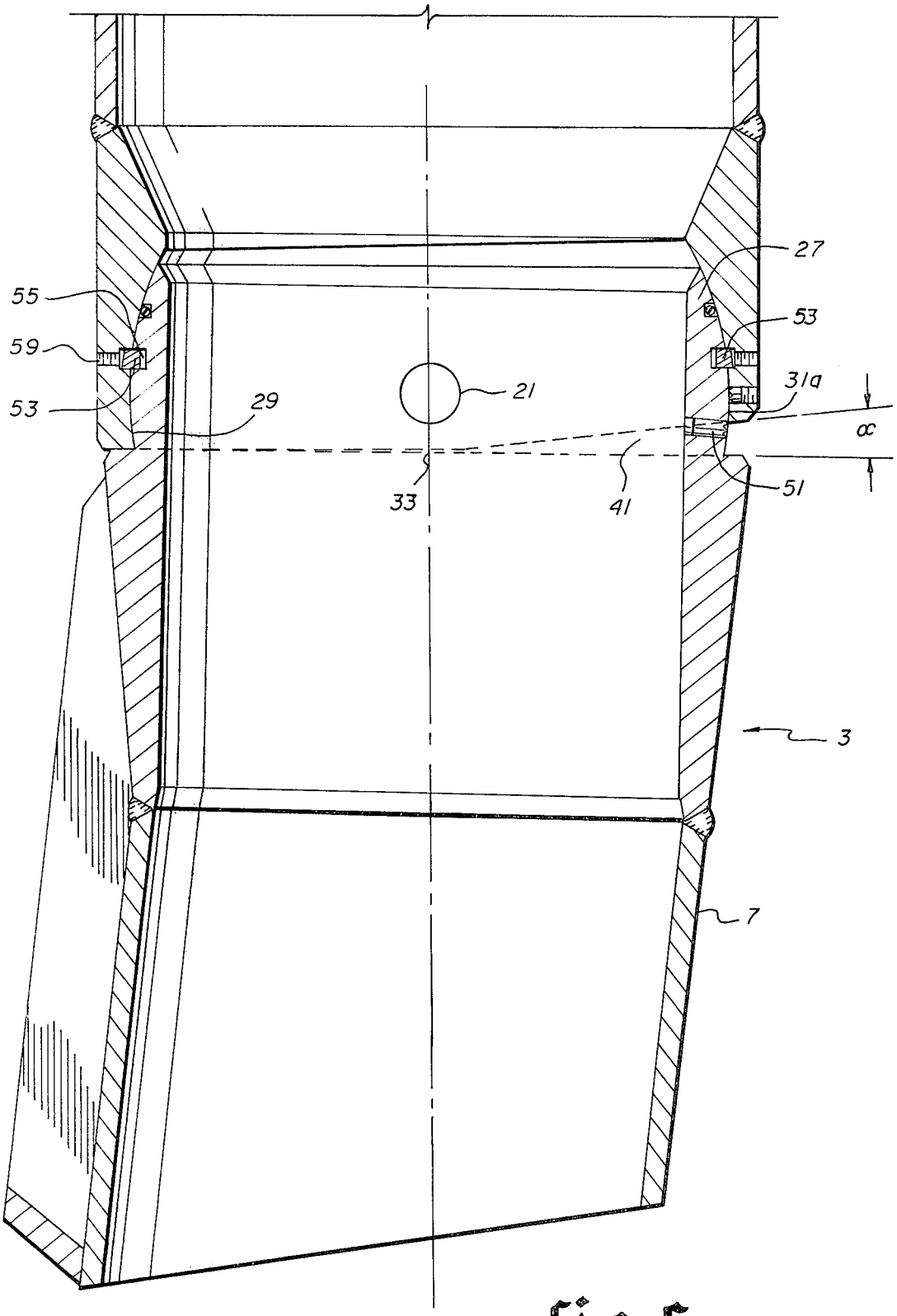
FIG. 6 is a vertical section view along the plane 6—6 of FIG. 2.
Figure 8:
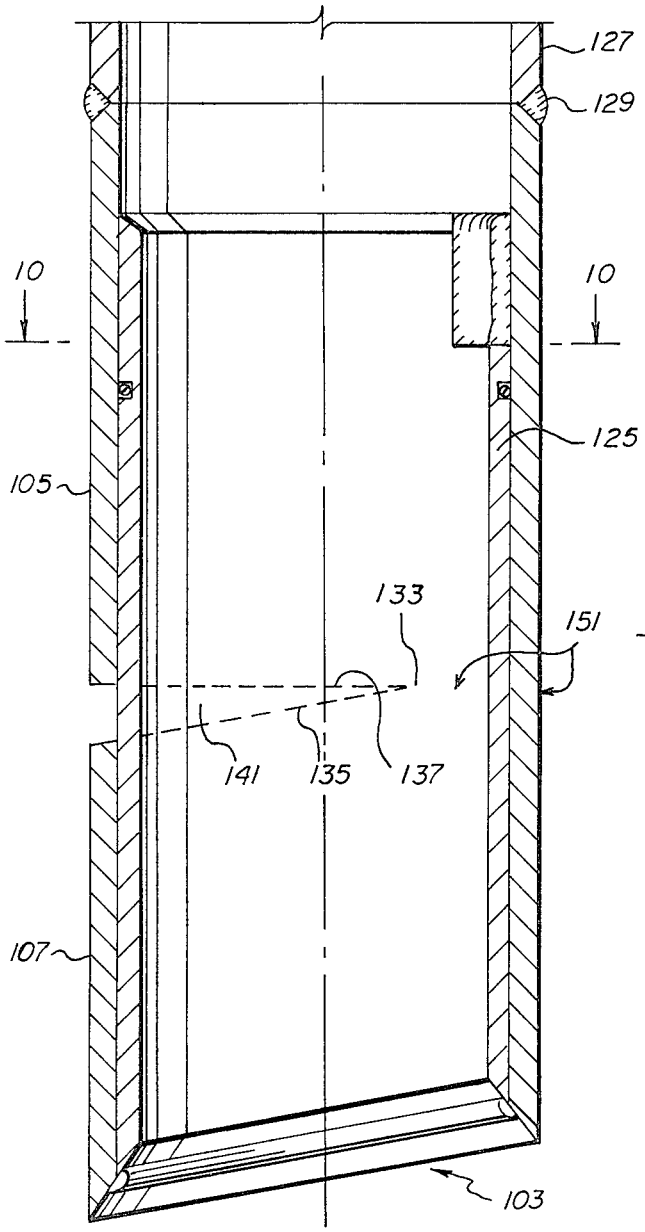
FIG. 8 is a vertical section view through an alternative collapsible drive shoe embodying the features of the invention taken along the plane 88 of FIG. 3.

In FIGS. 5 and 6 there is shown the vertical cross-sectional views of the shoe 3. In FIG. 5, the shoe is shown with its components axially aligned as it is introduced through guide means 17 of a platform (FIG. 1). Due to the axial alignment of the center lines of both the upper support means 5 and the lower movable shoe means 7, there is provided an elongate, driving shoe 3 with parallel sides that easily fits through aligned guide means. Thereafter, and at a desirable calculable depth and, as shown in FIGS. 2 and 6, the shoe 3 moves to its articulated position about the pivot pin 21.

As best shown in FIG. 5, the lower movable shoe means 7 is movably connected to the upper support means 5 by a cooperating coupling means 25 which provides for pivotal movement of the lower shoe means 7 with respect to the upper shoe means 5 about an axis point. The direction of deviated movement of the conductor 9 shall be in the direction of pivotal movement of the lower shoe means 7 and perpendicular to the axis, i.e. the pivot pin 21. The coupling means 25 consists of structure providing relative movement of the two components of the shoe 3, and may, for example, include a bearing surface 27 which is arcuate in vertical cross-section and substantially circular in horizontal cross-section. The bearing surface 27 is characterized by an oppositely disposed lower terminal points 21*a* and 29*b*. The lower termination points 29*a* and 29*b* lie on the arcuate path, in vertical cross-section, of the bearing surface 27, but below the arcuate apex 31*a* and 31*b* of the bearing surface 27 when viewed in vertical cross-section. Thus, there is provided shelf means 29 defined by the circumference allowing and providing for clockwise movement of the lower movable shoe means 7 about the pivot pin 21 over the fulcrum means 33 so that the exterior mating shelf 35 of shoe means 7 moves into engagement with the lower mating shelf 37 of support means 5, see FIG. 6. Prior to the movement of shoe means 7 from its linear aligned position (FIG. 5), the exterior mating shelf 35*a* of shoe means 7 is in engagement with the lower mating shelf 37*a* (see FIG. 5), but in this position, the upper support means 5 and the lower shoe means 7 are linearly aligned so that the collapsible drive shoe may thus easily be introduced through the series of guide means 17 supported by the offshore structure.

It will thus be recognized that the lower mating shelf 37 and the exterior mating shelf 35 result in a bevel or pie-shaped cut in the surface of the assembly of the collapsible drive shoe 3, this bevel cut 41 being characterized by an apex extending to and coinciding with the fulcrum means 33, as shown in FIG. 5, but it will be recognized that the apex may extend past the fulcrum means 33, this requiring simple redesign of the lower mating shelf 37 and the upper mating shelf 35. The fulcrum means 33 resides in off center relationship to the pivot pin 21, that is, the fulcrum point resides in over-the-center relation with respect to the pivot pin 21 which, as shown in FIG. 5 bisects the center lines C-1/C-2 of the shoe 3.

Other design factors may be utilized in arrangement and configuration of the operative components for the purpose of influencing the magnitude of resistive force necessary to cause articulation of the lower shoe means 7. For example, movement of the fulcrum means 33 toward the center lines C-1/C-2 would tend to increase the requisite amount of resistance force R necessary to produce articulation. Conversely, movement of the fulcrum means toward the apex of the bevel cut 41 tends to reduce the magnitude of resistive force R necessary to produce articulation of the shoe means 7. The degree of arcuate movement of articulating shoe means 7 is determined by the arcuate magnitude of the bevel cut 41. Thus, the degree of arcuate separation of making shelves 35 and 37 when lower mating shelf means 37*a* and exterior shelf means 35*a* are in abutting relationship determine the extent of arcuate movement of the lower shoe means 7 with respect to center line C-1 of the conductor 27 and upper support means 5, see FIG. 6.

As shown in FIG. 6, the bevel cut 41 closes when the resistance force R induces the movement of the lower shoe means about the pivot pin 21 and due to the position of fulcrum means 33 the lower shoe means 7 locks in the over-the-center position produced by the relative location of pivot pin 21 with respect to fulcrum means 33. The arcuate magnitude of bevel cut 41 thus shifts to the diametrically opposite side of the shoe 3 after the lower shoe means 7 has articulated to the deviated position, see FIG. 6, and the magnitude of deviation corresponds to the magnitude of the arc of the bevel cut 41 defined by the lower mating shelf 37 and the exterior mating shelf 35, see FIG. 6, angle $\alpha$.

Prior to movement of the lower shoe means 7 to the deviated position of FIG. 6, the upper support means 5 and the shoe means 7 reside in coinciding linear relationship and are sufficiently locked in this relationship by the aforedescribed type of mechanical relationships and a resident shear pin or other locking means 51. Upon occurrence of the necessary resistive force R, the pivotal movement of lower shoe means 7 to the deviated position causes shearing of the lock means 51. Varying thicknesses of lock means 51 may be utilized to vary the necessary resistive force R to produce articulation. After the shoe means 7 has moved to the deviated position defined by the arc $\alpha$, a second locking means is automatically actuated to fixedly position the respective components of the shoe 3 in their deviated relationship. This is accomplished by use of a partial or fully circumferential snap ring 53, or the like, which may reside within a recess located in either the circumferential bearing surface 27 (see FIGS. 5 and 6) or in the inner arcuate bearing surface in the upper support means 5. A cooperating recess or shelf means 55 is provided in the opposing wall, such as for example as shown in FIG. 5. Thus, the relative position of shelf means 55 to the snap ring 53 is defined by the magnitude of movement determined by the movement of the respective walls of the bevel cut 41. After the shoe means 7 has moved to the articulated position of FIG. 6, the snap ring 53 expands to engage cooperating shelf means 55, thus locking the shoe means 7 in the illustrated position. If desired, one or more lock out bolts 59 may be provided to disengage the lower shoe means from its articulated position.

Figure 10:
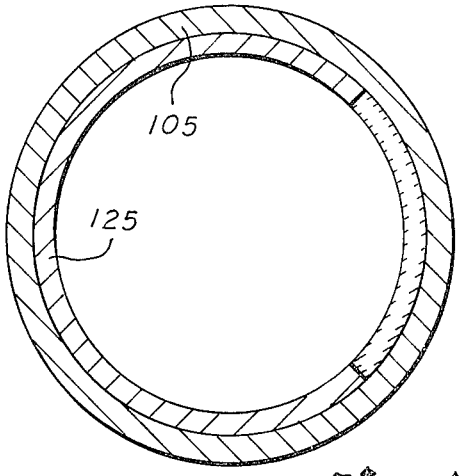
FIG. 10 is a horizontal section view along the plane 1010 of FIG. 8.
Figure 9:
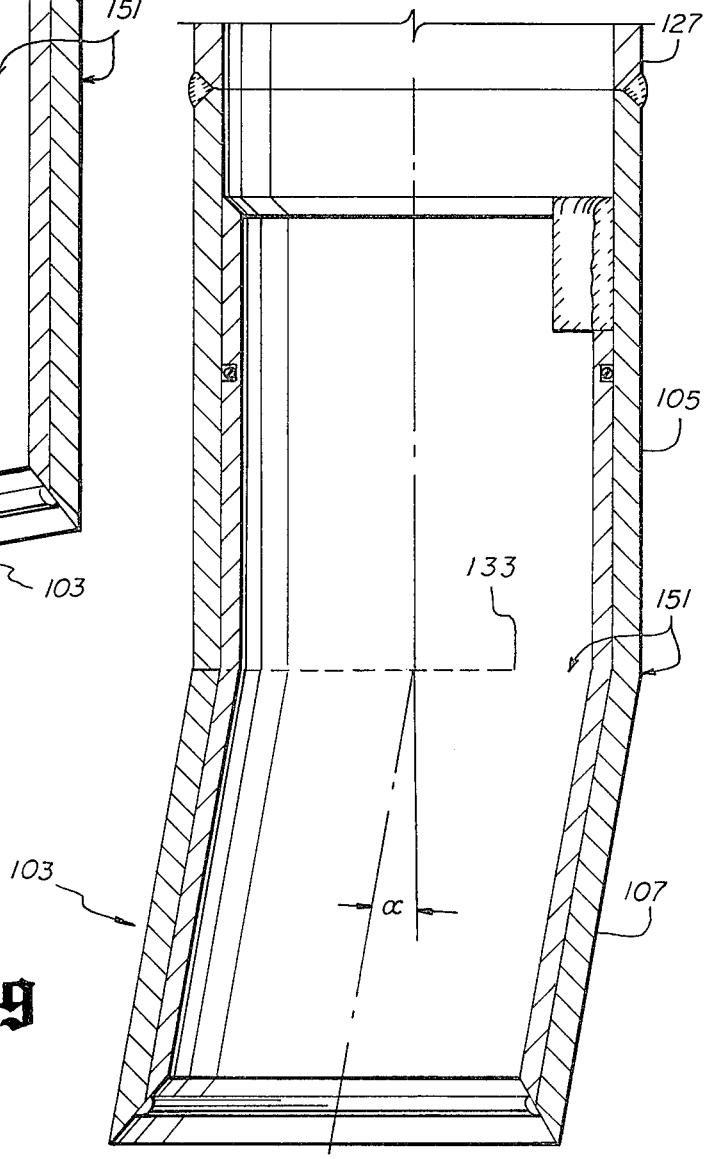
FIG. 9 is a vertical section view along the plane 99 of FIG. 4.

Shown in FIGS. 3, 4 and 8 through 10, is an alternative design for the collapsible drive shoe of the invention. Here, the collapsible drive shoe 103 consists of a cylindrical pipe and which is appropriately welded 129 to the conductor pipe 127. The shoe 103 is characterized by the two sections corresponding to lower shoe means 107 and upper support means 105. Upper support means 105 is characterized by a lower mating shelf 137. Lower shoe means 107 is characterized by an exterior mating shelf 135. Lower mating shelf 137 and exterior mating shelf 135 define the bevel cut 141. As explained earlier, the magnitude of the arc $\alpha$ determines the extent of deviation of the lower shoe means 107 with respect to the center line of the conductor 127 and upper support means 105. Affixed within the shoe 103, such as by welding or other appropriate fusion technique, is a reinforcing inner liner constituting a component of the coupling means 125, although it is readily recognized that the uninterrupted integrity of contiguous wall section 151 constitutes an integral component of the overall coupling means between the upper support means 105 and the lower shoe means 107. As shown in FIG. 10, the reinforcing liner 125 encases the interior of the shoe 103, but for the bevel cut defined by the shelves 135 and 137 whose terminal ends coincide in fulcrum means 133. It may be visualized that reinforcing liner 125 corresponds to coupling means 25 and to the cooperating effect of lock means 51 and snap ring 53 in FIG. 5.

Figure 7:
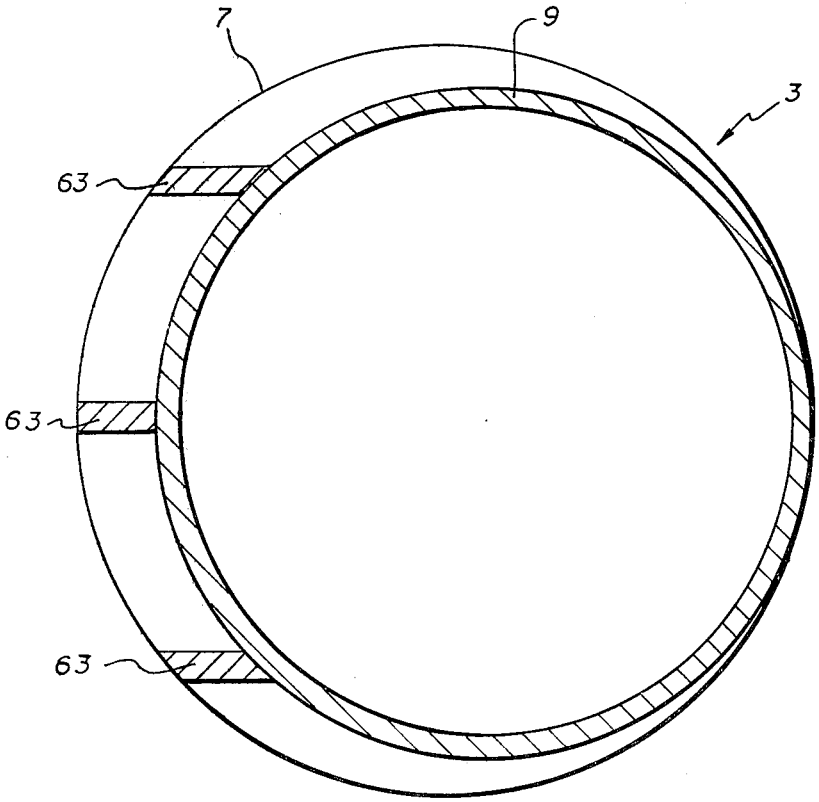
FIG. 7 is a top view of FIG. 6.

In FIg. 7 there is shown a sectional view through the shoe of FIG. 5 and clearly illustrating the stabilizer fins 63. Stabilizers 63 facilitate the directional movement of the conductor string by resisting circumferential movement or tangential forces on the conductor string after it begins its deviated movement within the substratum. Such resistance to rotational movement is enhanced by the magnitude of surface area provided by the sides of stabilizers 63 to such rotational forces and thereby assures better compass direction stability. Thus, the conductor pipe 27 can be driven into and beneath the floor 11 and substantially into the substratum before articulation of the lower shoe means 7 (107) begins. By analysis of the substratum in accordance with well known techniques, the magnitude of resistance R necessary to initiate articulation of the collapsible drive shoe can be calculated and the arcuate path of the conductor planned accordingly. The magnitude of resistive force characterizing the substratum composition can thereafter become a design factor in constructing the collapsible drive shoe 3, 103 of the invention. As explained above, such factors as the relative position of fulcrum means 33, 133 with respect to the center lines C-1/C-2 and the shearing forces for lock means 51,151 may be utilized in constructing a collapsible shoe, the articulated movement of which may be predictably initiated at a designated depth within the substratum. Likewise, the distal end of the movable shoe means 7, 107 is characterized by an angulated shovel surface means 61 which influences the resistive force or design characteristics necessary for articulation.

In operation of the collapsible drive shoe of the invention, the conductor pipe 27 is first positioned in conventional and well known manner so as to present a relatively facile position for engagement by workmen on a deck of the platform. The collapsible drive shoe, such as one shown for example in FIGS. 5 or 8 herein, is then welded to the bottom end of the conductor such as with the bevel weld shown. The conductor casing is then driven or otherwise forced through the floor 11 of the body of water and into the substratum in such a manner that the shoe 3 is driven to a predetermined substratum depth. When the predetermined substratum depth is reached, the resistive forces R thereat induce and cause collapse of the lower shoe means to begin, and to continue until the bevel cut 41 is closed so that the mating shelves 35,37 defining the bevel cut move into abutting relationship. Thereafter, driving of the conductor casing is continued on through the substratum in such manner that the casing assumes the desired curvature and direction as it advances. In addition, the stabilizing fins 63 effectively resist undesired rotation of the conductor pipe which may otherwise introduce undesirable movement of the pipe from its intended path.

It will be recognized that variance in the magnitude of the arc of bevel cut 41 will cause greater or lesser curvature in the movement of the casing string as it advances through the substratum. The relative degree of arc characterizing the bevel cut may be based on a study of the soil data, as well as field experience. Similarly, it is recognized that the magnitude of energy applied to the pipe by means of the pile driving hammer affect the operation of the collapsible driven shoe.

Numerous and varying different embodiments may be made within the scope of the inventive concept taught herein, and due to the fact that these numerous modifications may be made to accomplish the functions of the embodiments described herein and through varying changes may appear it is to be understood that the details herein are to be interpreted as illustrative and not in any sense limiting.

That which is desired to be secured by United States Letters Patent is:

1. In a conductor shoe means for attachment to a conductor pipe to be driven into the earth for initiating deviation of the path of the conductor laterally of the longitudinal center line thereof at a depth is determined by the forces resistive to the continued driving of the conductor pipe comprising:

an upper support means affixed to the distal end of the conductor pipe, a lower shoe means adapted for movable articulation with respect to the upper support means and, pivot means affixing the lower movable shoe means to the upper support means to move the lower shoe means relative to the upper support means in response to the resistance forces so as to angularly dispose a surface of the lower shoe means with respect to the axis of the conductor pipe for inducting lateral deviation from the center line.

2. The apparatus of claim 1 wherein the conductor shoe means includes stabilizer means for resisting tangential forces exerted thereon during driving and enhancing driving accuracy to the objective.

3. The apparatus of claim 2 wherein said upper support means and lower shoe means are each characterized by a cooperating mating surface means for abutting one another after pivotal movement and to thereby determine the angle of deviation of the conductor pipe means.

4. The method for driving a pipeline beneath the earth in a substantially vertical direction to a predetermined point of resistance and then curving the path of the pipeline beneath said point comprising the steps of:

positioning a pipe joint in its desired position and affixing to the distal end thereof a drive shoe means with the longitudinal axis thereof aligned co-axially with the longitudinal axis of the pipe joint;

positioning the pipe and drive shoe means to a desired depth in the substratum where substratum resistance to driving of the pipe induces articulated movement of the drive shoe means so that the longitudinal axis thereof is angularly moved in relation to the longitudinal axis of the pipe joint to which it is affixed so that continued driving of the pipe causes lateral deviation of the pipeline.

5. The method of claim 4 wherein there is included the additional step of:

adding at least one projecting stabilizer along the exterior of the collapsible conductor shoe means parallel to the longitudinal axis thereof to minimize the effect of rotational forces on the conductor casing.

6. A marine structure established in a body of water from which drilling is carried out beneath the floor of the water from a drilling deck on the structure and having at least one drilling aperture therein, at least one first conductor casing slideably situated within said drilling aperture for insertion and bending beneath the floor in the substratum thereof, the improvement comprising:

an articulated bending shoe assembly affixed to the lower end of the conductor casing, including an upper support means and a lower movable shoe means, and coupling means affixing the lower movable shoe means to the upper support means for articulating the shoe means with respect to the support means after the assembly has been driven to a point beneath the floor where substratum resistance causes relative angular movement of the shoe means so as to deviate the conductor from its prior direction of movement.

7. The marine structure of claim 6 wherein said upper support means is characterized by a longitudinal axis parallel to and coincident with the longitudinal axis of the conductor and, said lower movable shoe is characterized by a longitudinal axis parallel to and coincident with the longitudinal axis of said upper support means so said articulated bending shoe assembly may be slidably moved through a drilling aperture of diameter substantially the same size as the diameter of the assembly.

8. The marine structure of claim 6 wherein the coupling means includes wall sections of each of the movable shoe means and upper support assembly in common relation to each other through only a portion of the circumference of the bending shoe assembly while the remaining portion of the circumference of the bending shoe assembly consists of a bevel shaped cut therein extending generally radially toward the common axis wherein each of the walls of the bevel cut are defined by respective walls of said upper support assembly and said lower movable shoe means so that application of a suffucient force generally axially of the assembly induces the collapse of the lower movable shoe means to close the bevel shaped cut and deviate the center line of the lower movable shoe from its parallel relation to the upper support means.

9. The structure of claim 6, including a lock means for mechanically fixing the relative position of the lower movable shoe means with respect to the upper support means after the latter has been pivotally moved with respect to the former.

10. The structure of claim 6 wherein the coupling means includes an arcuately curved surface defined on said upper shoe means and an arcuately curved surface defined on said lower movable shoe means in slidably contacting relation with the arcuate surface of said upper support means providing for freedom of relative movement therebetween, pivot pins affixing the lower shoe means to the upper support means and disposed in opposite position to each other so as to limit slidable movement of the lower shoe means to the upper support means about the pivot axis, and a fulcrum means characterizing a lower surface of the upper support means disposed in off-center relation to the opposed pivot pins so that the lower shoe means is distrained against movement about said pivot pins by the position of the fulcrum means until sufficient moment force is exerted on the lower shoe means to urge it over the fulcrum means.

11. In a method for deviating conductor casing or the like comprising the steps of:

fabricating a conductor casing having a drive shoe affixed on the lower end thereof for deviating the casing, lowering the casing and drive shoe to the point of supportive resistance, driving the casing and drive shoe on the end thereof straight into the earth, deviating the drive shoe at an angle to the conductor thereafter to thus curve the path of the conductor as it is driven.

* * * * *